United States Patent [19]

Calgaro

[11] Patent Number: 4,601,656

[45] Date of Patent: Jul. 22, 1986

[54] GAS FLOWRATE REGULATING DEVICE FOR A LIQUEFIED-GAS LIGHTER

[75] Inventor: Honore Calgaro, Annecy, France

[73] Assignee: S. T. Dupont, Paris, France

[21] Appl. No.: 600,110

[22] PCT Filed: Jul. 29, 1983

[86] PCT No.: PCT/FR83/00161

§ 371 Date: Mar. 26, 1984

§ 102(e) Date: Mar. 26, 1984

[87] PCT Pub. No.: WO84/00601

PCT Pub. Date: Feb. 16, 1984

[30] Foreign Application Priority Data

Jul. 29, 1983 [FR] France ..... 82 13264

[51] Int. Cl.[4] ..... F23D 14/78

[52] U.S. Cl. ..... 431/344; 251/121

[58] Field of Search ..... 431/130, 131, 142, 143, 431/150, 254, 276, 277, 344; 251/121

[56] References Cited

FOREIGN PATENT DOCUMENTS 1632608 1/1967 Fed. Rep. of Germany .

7423896 7/1974 France .

*Primary Examiner*—Carroll B. Dority, Jr.

*Attorney, Agent, or Firm*—John P. Morley

[57] ABSTRACT

The invention relates to a device for regulating the flowrate of a liquefied-gas lighter of the type having an elastic permeable disk (11) through which the gas passes and two compression elements able to compress respectively two different zones of this disk, an annular zone and a central zone, one of the compression elements (5) being composed of an annular compression screw rotationally integral with a control element (7) while the second compression element (17) passes through said annular compression screw to ensure compression of the central zone of the disk and is translationally integral with a control element (19). According to the invention, each of these control elements is accessible independently, from the outside of the lighter.

4 Claims, 3 Drawing Figures

GAS FLOWRATE REGULATING DEVICE FOR A LIQUEFIED-GAS LIGHTER

The present invention relates to a gas flowrate regulating device for a liquefied-gas lighter and, in particular, a device enabling the maximum height of the flame which can be furnished by the lighter to be adjusted to a given value.

Most gas flowrate regulating devices for liquefied-gas lighters employ a compressible element, which may or may not be traversed by the gas, which is compressed to a greater or lesser degree according to the gas flowrate desired. Some of these devices additionally have means enabling the gas flowrate, and hence the flame height furnished, to be limited to a given maximum value.

These means usually consist of a preregulation stage disposed on the gas path and causing it to undergo an additional pressure loss, this preregulation stage being disposed in series with the normal regulation stage.

It has been proposed to produce preregulation and regulation of the flame height of a lighter with the aid of a single permeable pellet. Thus, regulating devices are known from French Pat. No. 2,277,305 wherein, on the one hand, preregulation is ensured by annular compression of a permeable compressible disk by means of a first annular screw screwed into the body of the expander and, on the other hand, regulation is ensured by central compression of the same disk by means of a second screw screwed into an internal thread of the first.

This type of device permits easy access to the preregulation and regulation means from the outside of the lighter and hence enables the maximum flame or utilization flame height to be corrected without disassembling either the preregulation or the regulation system.

However, a disadvantage inherent in this type of device resides in the fact that preregulation and regulation are not independent of each other, and that a modification in one is likely to modify the other. In fact, because the preregulation and regulation screws are screwed into each other, they are linked rotationally by the friction existing between their common threads.

German Pat. No. 1,632,608 has also proposed preregulation by means of an annular screw screwed into the expander body and regulation by means of a second screw screwed upstream of the first, also in the expander body, part of which passes through the annular screw to compress the elastic disk. Although this type of device ensures full independence of the two compression screws from each other, it does not permit access to the screw exerting the annular compression without first having disassembled the entire device.

The goal of the present invention is to remedy these drawbacks by proposing a gas flowchart regulating device of the aforesaid type wherein the preregulation system, namely regulation of the maximum flame height, and the system for regulation of the flame at the utilization height are both independent of each other and accessible from the outside of the lighter without disassembly and hence without going out of adjustment.

For this purpose, the object of the invention is a gas flowrate regulating device for a liquefied-gas lighter, of the type having an expander body provided in the lighter body designed to receive a permeable elastic disk traversed by the gas and two compression elements able to compress two different zones of this disk, an annular zone and a central zone, a first compression element composed of an annular compression screw screwed into the expander body and rotationally integral with a control element and a second element, known as the central compression element, traversing said annular compression screw to ensure compression of the central zone of the elastic permeable disk, said device being characterized by said central compression element being slidably mounted in the annular compression screw and being integral, at least translationally, with a control element screwed into the expander body.

The present invention ensures independence of the two regulating elements from each other by making access to each of them possible without having to disassemble the other.

In an advantageous embodiment of the invention, the screw control element ensuring annular compression and hereinafter called annular compression screw is composed of the element ensuring central compression and hereinafter called central compression screw and is rotationally integral with and translationally free from said screw.

The link between the annular compression screw and the central compression element can be brought about for example by lengthwise grooves with matching shapes provided on these two parts.

The control element of the central compression element can be made of a screw screwed into the expander body, said screw being translationally integral with and rotationally free from said central compression element.

The link between these two parts can, for example, be provided by a circular boss guided by two washers with a low coefficient of friction, or by roller means of the ball bearing type. In a particularly advantageous form of the invention, the control element of the annular compression screw is composed of the central compression element, the latter being translationally free from the annular compression screw, and the control element of the compression element being rotationally free from said compression element.

Various embodiments of the invention will be described hereinafter with reference to the attached drawings, wherein.

Figure 1:
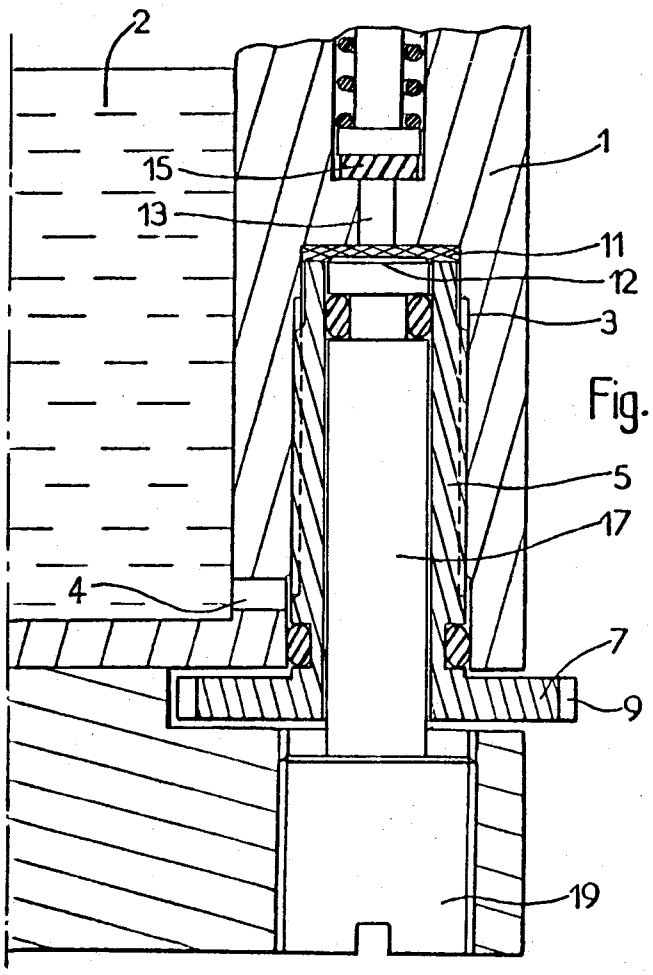
FIG. 1 is a partial lengthwise section of a lighter equipped with a gas flowrate regulating device according to the invention.

In FIG. 1, wall 1 of the lighter body constitutes the expander body. It is provided with a cavity 3 with internal threads such as to receive an annular compression element composed of a hollow screw 5.

One of the ends of screw 5 is provided with a crown 7 having entrainment teeth 9 on its periphery. Its other end rests on an elastic, permeable disk 11 accommodated in cavity 3. The latter communicates with the lighter burner by a duct 13 which can be closed by a valve 15; it also communicates by a lateral duct 4 with the liquefied-gas reservoir 2.

Screw 5 is traversed axially by a central compression element, composed of a piston 17, which at one of its ends is provided with a control element composed of a screw 19 screwed into the lighter body. Its other end 12 rests on the central part of disk 11.

Preregulation, namely regulation of the maximum flame that can be furnished by the lighter, can be accomplished with the aid of screw 5.

For this purpose, end 12 of piston 17 is first moved away from disk 11 in order not to produce a pressure drop at the central part of the disk.

The gas contained in reservoir 2 of the lighter arrives via duct 4 in the capillary passage separating the thread of screw 5 from that of cavity 3, passes through the annularly compressed part radially, then [through] the central part of disk 11, and arrives at the burner via duct 13 when valve 15 is open.

Tightening screw 5 to a greater or lesser degree with the aid of toothed crown 7 compresses disk 11 to a greater or lesser degree and the flame is adjusted to the desired height. Since, during this regulation, piston 17 does not participate in compression of the disk, the pressure loss it creates is negligible and the flame produced is then maximal.

To decrease the height of the flame and bring it to the desired utilization height one need only appropriately compress the central part of disk 11 by screwing down control element 19 to a greater or lesser degree.

Figure 2:
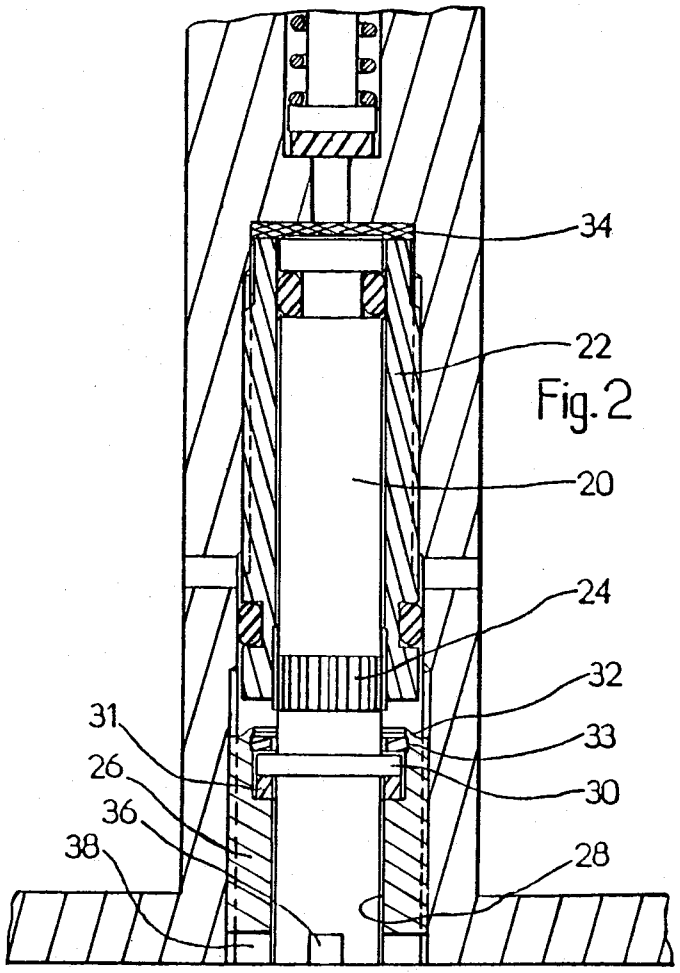
FIG. 2 is a section through a first embodiment of the invention, wherein the control element of the annular compression element is composed of the central compression element.

In the device of FIG. 2, the central compression element composed of a piston 20 constitutes the control element of the annular compression element composed of screw 22.

With this purpose, these two parts are linked rotationally by lengthwise grooves 24, which leaves them translationally free.

The control element of piston 20 is composed of a screw 26 provided axially with a recess 28 designed to receive said piston. The piston has a circular boss 30. This boss is located between two rings 31 and 33 made of a material with a low coefficient of friction such as, for example, polytetrafluoroethylene, and the entire assembly is held together by a crimp 32. Piston 20 and screw 26 are thus translationally integral and rotationally free.

During preregulation, to adjust the annular compression of disk 34, in other words to move screw 22 axially, piston 20 is entrained rotationally with the aid of a slot 36 provided at one of its ends. This rotation does not cause rotation of screw 26, but causes that of screw 22 and, and as a consequence, its axial displacement.

During the regulation operation, to adjust the central compression of disk 34, in other words to displace piston 20 axially, screw 26 is entrained rotationally with the aid of slots 38 provided at one of its ends. This rotation, in view of the good sliding coefficient of rings 31 and 33, does not cause rotation of piston 20 and thus has no effect on screw 22, but causes axial displacement of piston 20 and hence permits the compression of disk 34 at its central part to be adjusted.

Figure 3:
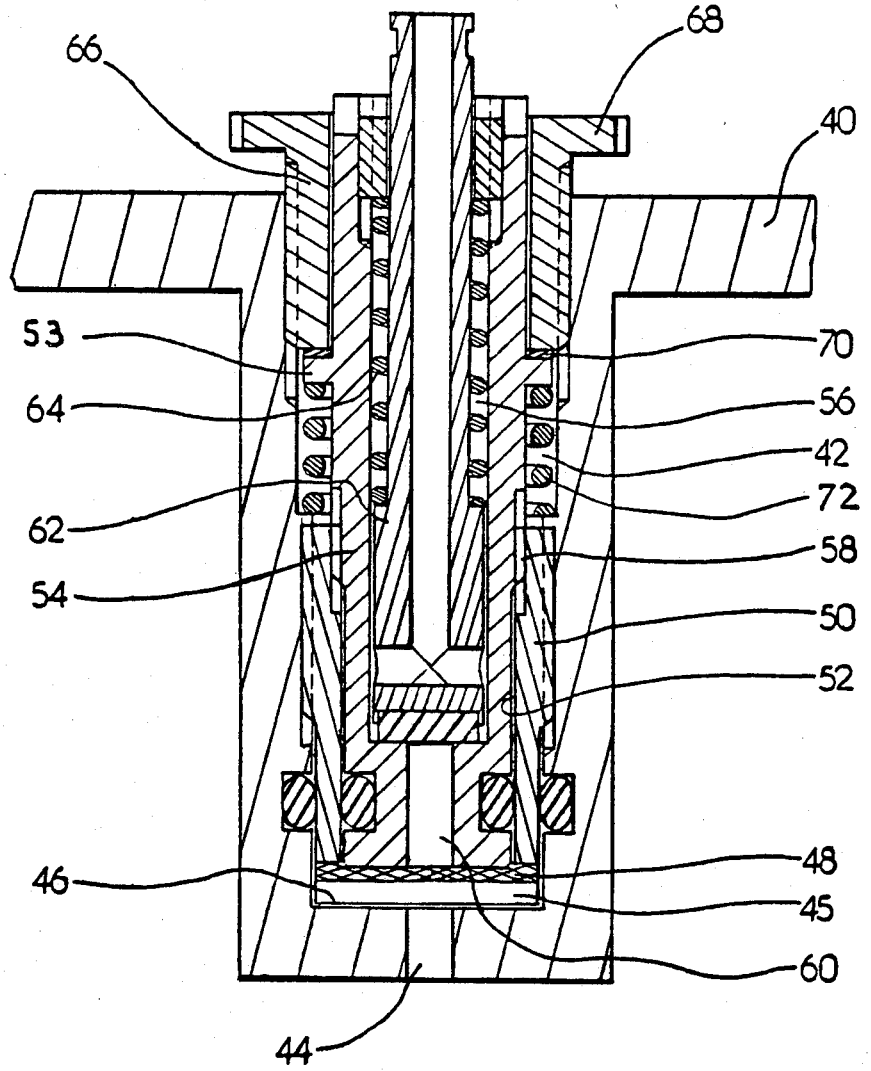
FIG. 3 illustrates a second embodiment of the invention wherein the preregulation and regulation operations are effected from the upper part of the lighter.

The embodiment shown in FIG. 3 permits preregulation and regulation of the flame height from the upper part of the lighter.

The upper surface 40 of a lighter body is provided with a well 42 with internal threads, provided at its base with a duct 44 in communication with the lighter reservoir, not shown in the drawing.

A metal disk 45, provided on its lower surface with fine grooves, is disposed on the bottom 46 of the well and supports an elastic permeable disk 48.

Disk 48 is compressed in its annular part by a compression element composed of a screw 50 provided with a recess 52.

This recess receives the central compression element, composed of a piston 54 provided on its inside with a cavity 56. This piston and screw 50 are provided with grooves 58 designed to ensure their rotational integration while permitting their translational freedom. Recess 52 is provided with a gas inlet duct 60. This duct is closed by a valve 62 which also serves as a burner. It is set to the closed position by a spring 64 and to the open position by means acting against the spring and not shown in the drawing.

The control element of piston 54 is composed of a hollow screw 66 provided with toothed collar 68 and screwed into the upper part of well 42.

A spring 72, compressed between the lighter body and a circular boss 55 of piston 54 applies this boss against the base of screw 66, with interposition of a washer 70 with a low coefficient of friction. Thus, screw 66 and piston 54 are translationally integral and rotationally free.

When the gas valve is open, the gas admitted by duct 44 passes around metal disk 45 and passes successively through the annular compression zone and the central compression zone of elastic permeable disk 48 where it undergoes pressure losses resulting from compression of these two zones.

To adjust the compression of the annular zone, piston 54 is rotated which, by means of grooves 58, causes screw 50 to rotate, thus causing greater or lesser compression of the annular zone.

To regulate the compression of the central zone, screw 66 is rotated. Thus the latter moves axially in well 42 and entrains piston 54 in this movement, which compresses the central zone to a greater or lesser degree.

Hence the invention provides a simple and easy-to-use method of independently regulating the maximum flame height of a lighter and the utilization height of the flame.

I claim:

1. A device for regulating the gas flowrate of a liquified-gas lighter of the type having an expander body provided in the lighter body which includes an elastic permeable disk (34, 48) traversed by gas and having an annular and a central zone, said device comprising a first compression element (22, 50) adapted for compressing said annular disk zone and a second compression element (20, 54) adapted for compressing said central disk zone and which further functions as a control element for the first compression element, the first compression element comprising an annular compression screw screwed into the expander body, the second compression element being slidably mounted in the first compression element and rotationally coupled to the first compression element so that rotation of the second compression element can axially displace the first compression element to compress said annular zone, said device further including a control element for the second compression element, said control element being screwed into the expander body and arranged in operational communication with the second compression element to provide non-rotational axial displacement of the second compression element on rotation of the control element for the second compression element to compress said central zone.

2. Regulating device according to claim 1, characterized by the first compression element (22, 50) and the second compression element (20, 54) rotationally coupled by means of lengthwise grooves (24, 58) with matching shapes provided on these parts.

3. Regulating device according to claim 1, characterized by control element (26, 66) of central compression element (20, 54) cooperating by means of an external boss on either of these elements, to provide non-rotational axial displacement of the central compression element.

4. Regulating device according to claim 3, characterized by elements with a low coefficient of friction or ball bearings interposed between said boss (30, 53) and the part axially displaced.

* * * * *